US005484021A

United States Patent [19]

Hailey

[11] Patent Number: 5,484,021

[45] Date of Patent: Jan. 16, 1996

[54] METHOD AND APPARATUS FOR FORMING A WINDOW IN A SUBSURFACE WELL CONDUIT

[76] Inventor: Charles D. Hailey, 11628 Burning Oaks, Oklahoma City, Okla. 73150

[21] Appl. No.: 335,585

[22] Filed: Nov. 8, 1994

[51] Int. Cl.[6] ..... E21B 7/08; E21B 29/06; E21B 17/05

[52] U.S. Cl. ..... 166/297; 166/55; 166/117.5; 175/79

[58] Field of Search ..... 166/297, 55, 55.1, 166/117.5

[56] References Cited

U.S. PATENT DOCUMENTS

| | | | |
|---|---|---|---|
| 2,147,491 | 2/1939 | LeBus | 464/19 |
| 2,194,267 | 3/1940 | Brock | 175/61 |
| 4,397,360 | 8/1983 | Schmidt | 175/61 |
| 4,699,224 | 10/1987 | Burton | 175/325.4 X |
| 4,739,843 | 4/1988 | Burton | 175/73 |
| 5,277,251 | 1/1994 | Blount | 166/117.5 |
| 5,287,921 | 2/1994 | Blount | 166/117.6 |
| 5,346,017 | 9/1994 | Blount | 166/380 |
| 5,368,109 | 11/1994 | Pittard, Jr. et al. | 175/45 |

*Primary Examiner*—Stephen J. Novosad
*Attorney, Agent, or Firm*—McKinney, Stringer & Webster

[57] ABSTRACT

A method and apparatus for forming a window in well casing. First, using coiled tubing, a two stage whipstock is set in the well casing through the production tubing. Next, a jointed milling assembly is inserted through the production tubing, also using the coiled tubing. The travel of the mill is guided by the two stage guide surface of the whipstock, and the joint in the milling tool allows the direction of the mill to change. Thus, the mill impinges on the well casing at a relatively acute angle to the longitudinal axis of the casing reducing the likelihood that the mill will bite into the guide surface of the whipstock instead of the well casing.

11 Claims, 6 Drawing Sheets

METHOD AND APPARATUS FOR FORMING A WINDOW IN A SUBSURFACE WELL CONDUIT

FIELD OF THE INVENTION

The present invention relates generally to methods and apparatus for forming windows in subsurface well conduits.

SUMMARY OF THE INVENTION

The present invention is directed to an apparatus for forming a window in a subsurface well conduit. The apparatus comprises a mill, a motor and a joint. The joint comprises a first end member with a first end adapted for connection to the motor and second end. The joint further comprises a second end member having a first end adapted for connection to the mill and a second end. The joint further comprises a joint assembly for connecting the second ends of the first and second end members, and the joint is characterized as permitting angular movement of the mill relative to the longitudinal axis of the motor and as preventing rotational movement of the mill relative to the motor. The first end member, the joint assembly and the second end member define a continuous longitudinal passage for fluid flow therethrough between the mill and the motor.

Still further, the present invention is directed to a method for forming a window in a subsurface well conduit. In accordance with this method, a whipstock is set inside the conduit at a selected location. The whipstock is characterized by a two stage guide surface. A jointed milling assembly then is lowered into the conduit above the whipstock using coiled tubing. The jointed milling assembly is advanced until the mill impinges on the first stage of the whipstock's guide surface, thereby bending the joint of the jointed milling assembly and directing the mill at the conduit. Advancement of the jointed milling assembly along the guide surface of the whipstock is continued until the mill passes the second stage of the guide surface, whereupon the joint straightens. Advancement of the jointed milling assembly, or a non-jointed milling assembly, is continued until formation of the window is completed.

DETAILED DESCRIPTION OF THE PREFERRED EMBODIMENTS

In subterranean formation operations, there occasionally is a need to drill secondary or deviated wellbores lateral to an existing vertical wellbore. It is becoming increasing popular to accomplish these "sidetracking" operations, as well as drilling horizontals with multiple laterals, by using coiled tubing. Various operations can be performed with coiled tubing by running tools attached to the coiled tubing through the production tubing. This eliminates the time and expense of removing and replacing the production tube to perform the procedure and eliminates the need for drilling rigs. Thus, the use of coiled tubing makes sidetracking and lateral drilling operations simpler and more feasible.

However, new problems are presented by drilling operations performed through the production tubing using coiled tubing bottom hole assemblies. Among these problems is the need to develop small diameter coiled tubing tools which can be introduced through the small diameter production tubing, but which will operate accurately and effectively in the larger diameter casing below the end of the production tubing. More particularly, there is a need to develop tools and techniques for cutting windows in the casing through which the lateral drilling procedures can be performed.

In traditional lateral drilling operations, a whipstock is positioned in the well casing for directing the milling tool at the casing in a predetermined location. The whipstock is a long tool which in longitudinal section is a right triangle, the flat bottom resting on a stinger on a packer, the straight back conforming to the casing opposite the selected window site, and the hypotenuse forming a gently sloping guide surface for directing the travel of a milling or drilling tool.

Where the production tubing has been removed, it is possible to use a whipstock with an outer diameter (at its base) which is only slightly less than the internal diameter of the casing. Thus, the whipstock is snugly seated in the wellbore, the back side supported along its entire length by the surrounding casing. When the milling tool contacts the top of the whipstock, the tool is guided toward the casing and mills or drills through it.

Where coiled tubing is used to introduce drilling or milling tools through the production tubing, it is necessary to use whipstocks and tools with diameters which are substantially smaller than the diameter of the casing at the level where the window is to be formed. An apparatus and method for setting a small diameter whipstock in a well casing are shown and described in U.S. Pat. No. 5,346,017, issued Sep. 13, 1994, entitled METHOD AND APPARATUS FOR SETTING A WHIPSTOCK, the contents of which are incorporated herein by reference.

Figure 1:
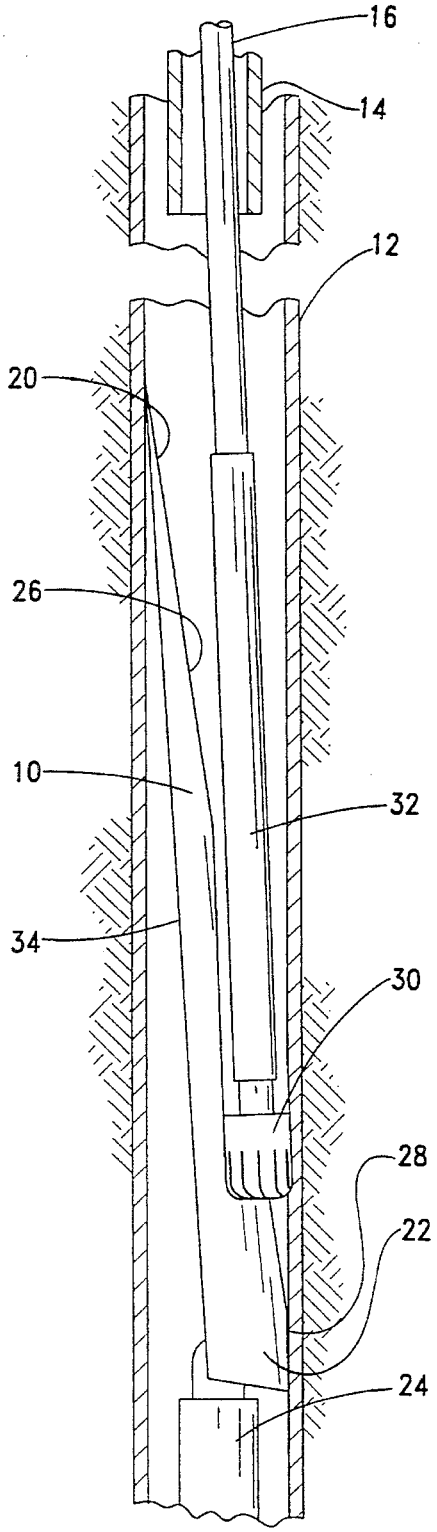
FIG. 1 is a longitudinal sectional view through a length of a well casing showing a whipstock and a milling tool cutting into the whipstock instead of through the well casing.

As shown herein in FIG. 1, in accordance with the teachings of U.S. Pat. No. 5,346,017, the whipstock 10 is positioned inside the well casing 12. The whipstock 10 has been dropped through the production tubing 14 by coiled tubing 16 by a coiled tubing assembly (not shown) set up near the well head in a known manner. The whipstock is tipped over so that the upper end 20 of the whipstock 10 rests on the inner wall of the casing 12. The bottom 22 of the whipstock 10 rests on a connector 24 which is supported on a packer (not shown). The guide surface 26 terminates near the bottom 22 in a non-sloping portion 28 which contacts along its length the inner wall of the casing 12.

Once the whipstock 10 is set in the well casing 12, a conventional mill 30 attached to a motor 32 is dropped through the production tubing 14 on the end of the coiled tubing 16. Ideally, the mill 30 will bite into the casing and form a window.

However, although the whipstock design of U.S. Pat. No. 5,346,017 is an improvement over the prior art, preferential biting of the mill 30 into the guide surface 26 of the whipstock 10 instead of the casing wall 12 still occurs in some cases, as illustrated in FIG. 1. As the mill 30 is driven down the guide surface 26 by the coiled tubing 16, the unsupported back side 34 of the whipstock 10 tends to flex or bow away from the mill causing it to bite into the whipstock instead of the casing 12.

Figure 2:
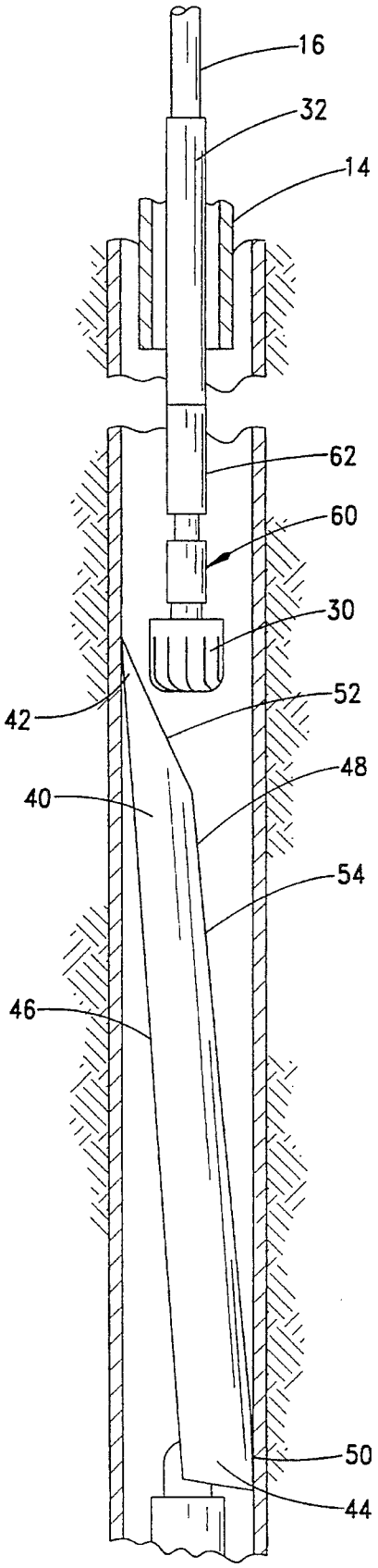
FIG. 2 is a longitudinal sectional view through a length of well casing showing a two stage whipstock and a jointed milling tool apparatus in accordance with the present invention.

To address this problem, a "two stage" whipstock has been developed and is the subject of U.S. Pat. No. 5,383,522, entitled WHIPSTOCK AND METHOD (application Ser. No. 08/242,764), and the contents of this application are incorporated herein by reference. A two stage whipstock 40 is shown in FIG. 2, to which attention now is directed.

The two stage whipstock 40 has an upper end 42 and a lower end 44. The two stage whipstock 40 is shown supported on a connector 24 like the whipstock 10 in FIG. 1. However, it will be appreciated that the two stage whipstock 40 may be set in the casing by other methods. The whipstock 40 has a straight back 46 and a sloping guide surface 48. As shown in FIG. 2, the guide surface 48 may terminate in a straight portion 50, similar to the non-sloping portion 28 of the whipstock 10 in FIG. 1. The guide surface 48 has first surface 52 and a second surface 54.

Figure 3:
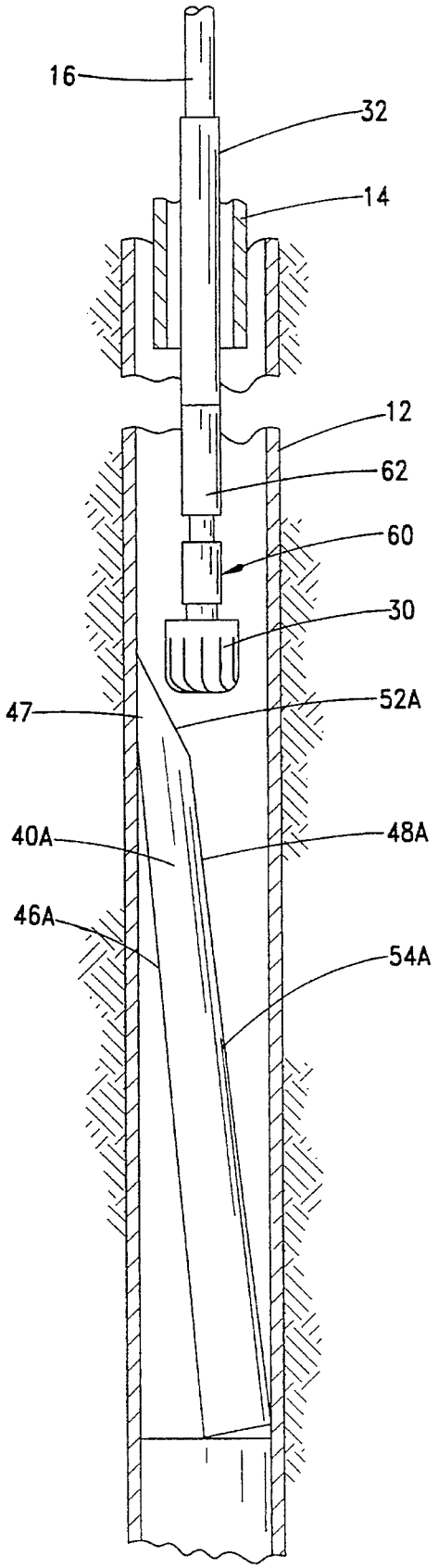
FIG. 3 is a side elevational view through another two stage whipstock having a different configuration from the whipstock shown in FIG. 2.

Another configuration for the two stage whipstock 40A, similar to that shown in U.S. Pat. No. 5,383,522 (application Ser. No. 08/242,764), is illustrated in FIG. 3. Like the whipstock 40 in FIG. 2, the whipstock 40A has a guide surface 48A with a first surface 52A and a second surface 54A. The whipstock 40A has straight back 46A with an angled portion 47 which is designed to contact the casing 12 as shown.

Now it will be understood that the essential feature of the two stage whipstock 40 (FIG. 2) or 40A (FIG. 3) is the division of the guide surface 48 (or 48A) into a first surface 52 (52A) and a second surface 54 (54A). The second surface 54 (54A) defines the gentle slope which guides the milling or cutting tool down the casing wall to form the window as known in the art. The first surface 52 (52A) is at an angle to the second surface and serves to direct the mill towards the casing 12 in a manner to be described in more detail below.

Also illustrated in FIGS. 2 and 3 is a milling assembly 60 in accordance with the present invention. The milling assembly 60 is supported at the end of the coiled tubing 16 and introduced through the production tubing 14 as described above. The milling assembly 60 comprises a conventional motor 32 and mill 30. It will be understood that the mill may be any one of several known milling tools, and preferably a starting mill.

The milling assembly 60 of the present invention includes a joint 62 by which the mill 30 is operatively connected to the motor 32. As used herein, "joint" refers to a flexible connector device, such as a knuckle joint. While not wishing to be limited to any particular joint structure or design, a preferred knuckle joint for use in the present invention is the SEALED TORK-THRU KNUCKLE JOINT brand marketed by Thru-Tubing Technologies, Inc. (Lafayette, La.).

Figure 4:
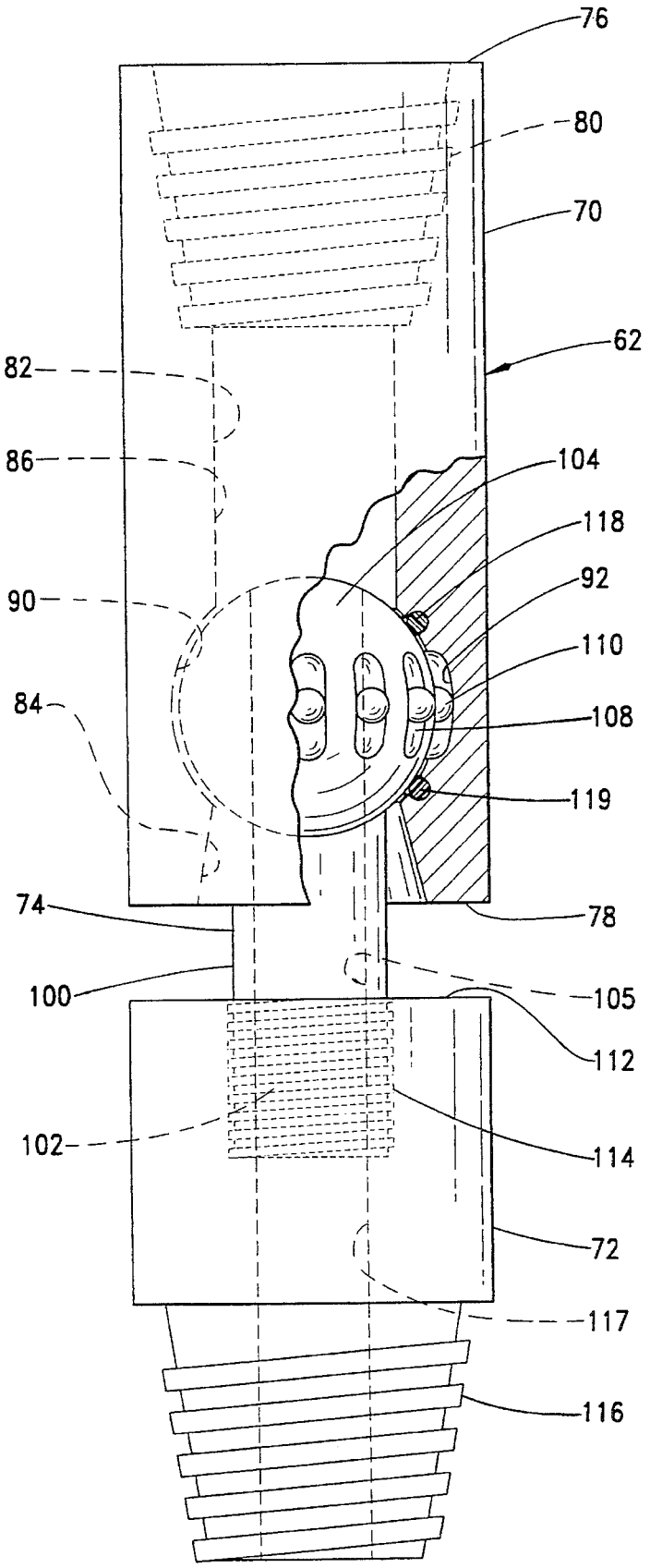
FIG. 4 is a partially cut away side elevational view of a joint for connecting the mill to the motor and suitable for use in the practice of this invention.

With reference now to FIG. 4, the construction of this preferred knuckle joint will be described. The joint 62 comprises a first end member 70, a second end member 72 and a connector 74. The first end member 70 has a first end 76 and a second end 78. The first end 76 is adapted with internal threads 80 for connection to a motor 32 (see FIG. 2) in a known manner.

A through bore 82 extends from the threads 80 at the first end 76 to the second end 78 where the through bore 82 terminates at the second end 78 in a frusto-conical portion 84. Between the frusto-conical portion 84 and the straight central portion 86 of the through bore 82, the through bore defines a concave portion 90. The concave portion 90 of the through bore 82 is provided with a plurality of elongated recesses 92 disposed so that the longitudinal axis of the recesses 92 is generally parallel with the longitudinal axis of the straight portion 86 of the through bore 82.

The connecting member 74 comprises a shaft 100 having a threaded first end 102 and a second end in the form of a sphere or ball member 104. A through bore 105 extends the length of the connecting member 74. The ball 104 is shaped to be received in the concave portion 90 of the through bore 82. The ball 104 is equipped with a plurality of elongated recesses 108 about the same size and shape as the recesses 92 in the concave portion 90, and positioned so as to be opposite the recesses 92 when the ball is in position inside the first end member 70. A small ball bearing 110 is positioned between each recess 92 and its opposing recess 108.

The second end member 72 has a first end 112 with internal threads 114 and a second end 116 which is threaded. A through bore 117 extends the length of the member 72. The threads 114 of the first end 112 are sized to receive the threaded first end 102 of the shaft 100 of the connector 74. The threads on the second end 116 of the second end member 72 are sized to connect to the mill 30 (see FIG. 2) in a known manner.

Now it will be apparent that multi-directional movement of the shaft 100 at an angle to the longitudinal axis of the through bore 82 is permitted, such movement being limited by the frusto-conical portion 84 and the length of the recesses 92 and 108. On the other hand, rotation of the ball 104 about its longitudinal axis within the concave portion 90 is prevented. Thus, torque transmitted to the first end member 70 by the motor 32 is transmitted to the second end member 72 and the mill 30 (FIG. 2) supported thereon.

Fluid flow through the entire joint 62 is permitted by the through bores 82, 105 and 117. Fluid leaks into the space between the ball 104 and the concave portion 90 are prevented by upper and lower O-ring seals 118 and 119 positioned in annular seats in the concave portion 90. Thus, the mill 30 is operated by the motor 32 in the conventional manner.

Figure 5:
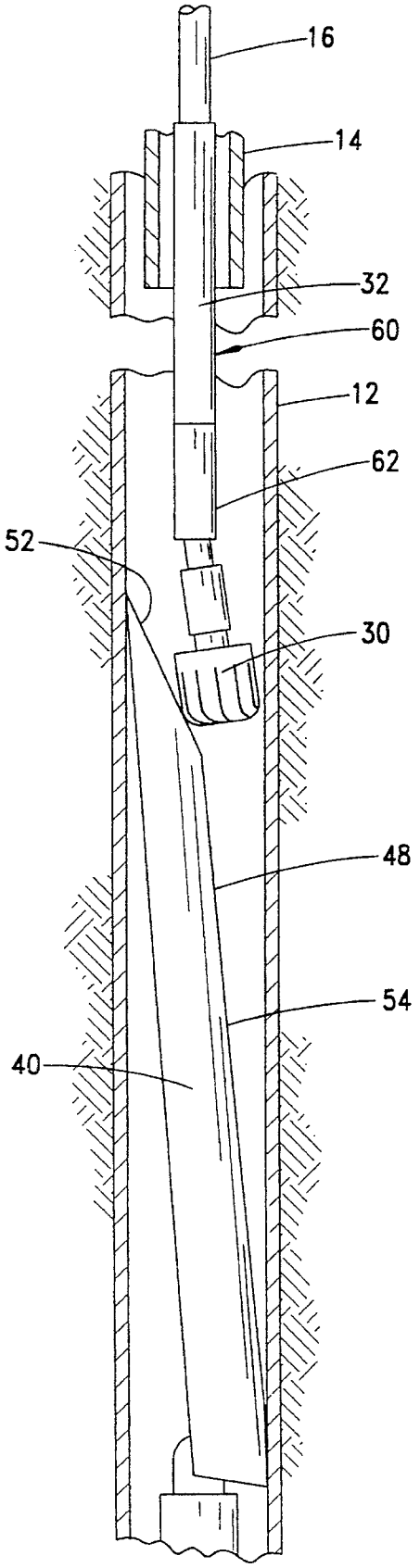
FIG. 5 is a longitudinal sectional view through the length of well casing shown in FIG. 2 and showing the milling tool as it impinges on the first stage of the whipstock and begins to turn toward the well casing.
Figure 6:
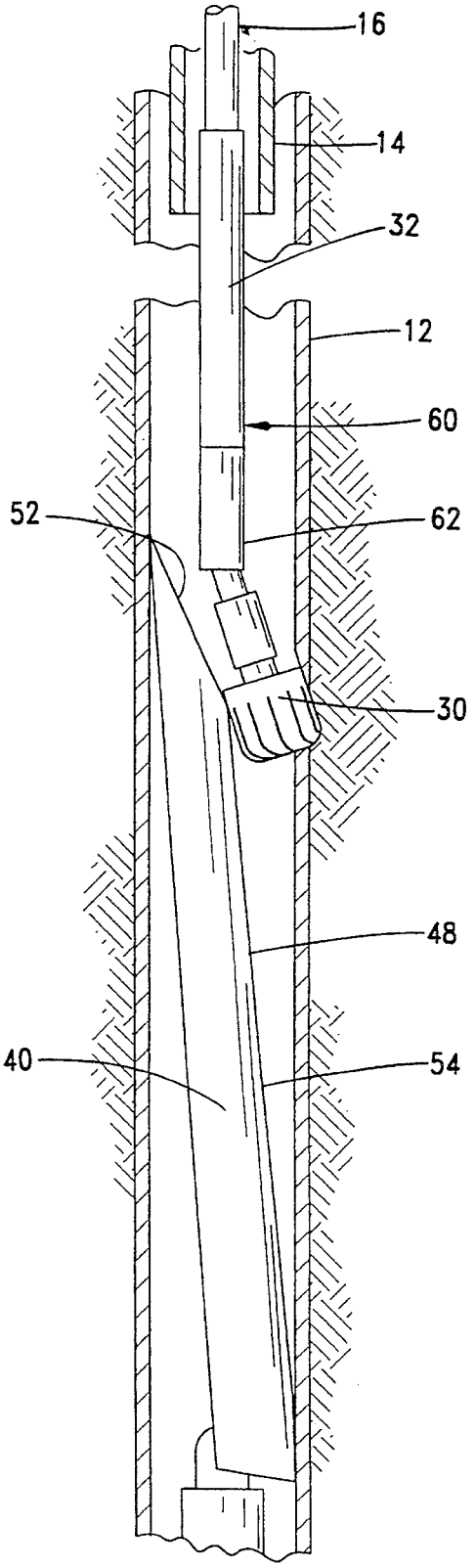
FIG. 6 is a longitudinal sectional view through the length of well casing shown in FIG. 2 and showing the milling tool as it leaves the first stage of the whipstock and begins cutting through the well casing.

Returning now to FIG. 2, in accordance with the method of the present invention, the whipstock 40 is installed in the well casing 12 and the milling assembly 60 is introduced through the production tubing 14, all as previously described. Next, as shown in FIG. 5, the mill is advanced until it impinges on the first surface 52 of the guide surface 48 of the whipstock 40. The pressure of this contact causes the joint 62 to bend or flex directing the mill 30 to towards the casing wall 12, as shown in FIG. 6.

Figure 7:
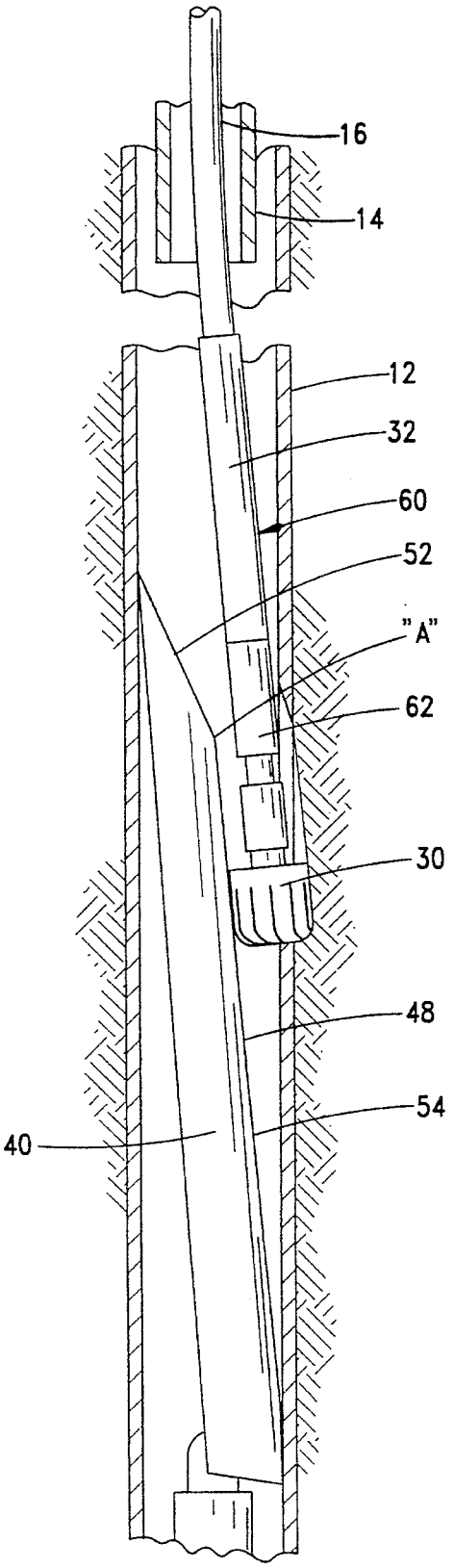
FIG. 7 is a longitudinal sectional view through the length of well casing shown in FIG. 2 and showing the milling tool as it drills down the second stage of the whipstock.
Figure 8:
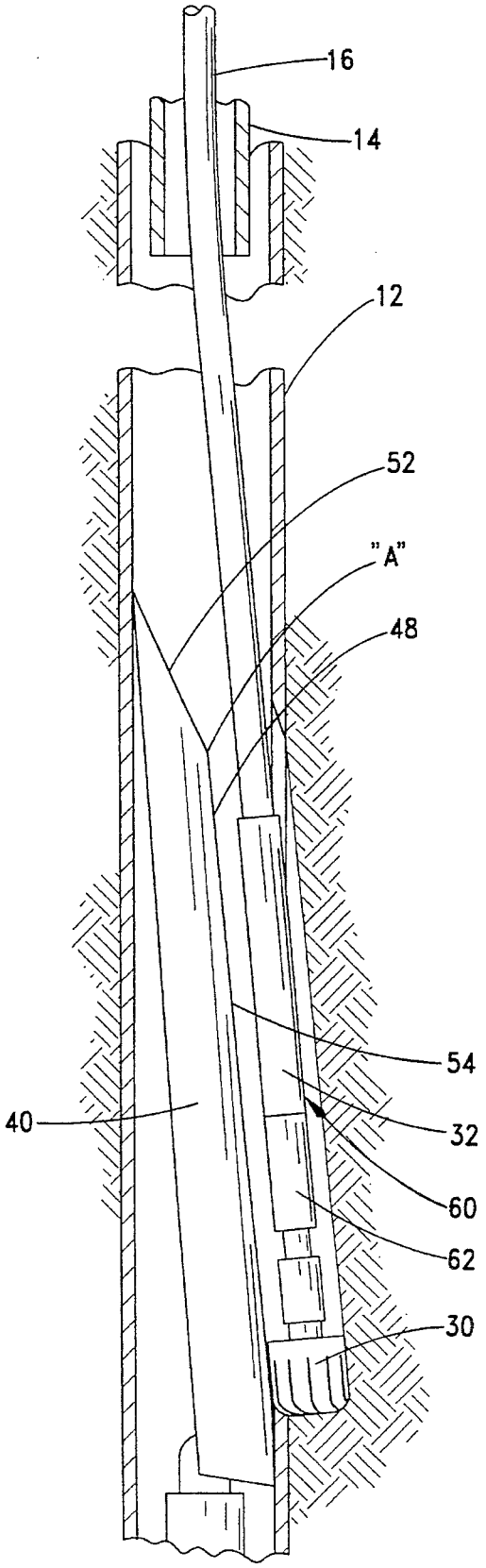
FIG. 8 is a longitudinal sectional view through the length of well casing shown in FIG. 2 and showing the milling tool as it approaches the end of the whipstock.

Advancement of the mill 30 is continued, as illustrated in FIGS. 7 and 8, so that the mill passes the angle "A." As shown, after the mill 30 has passed the angle A, the joint 62 straightens and the travel of the mill 30 then continues to be guided by the slope of the second surface 54 of the guide surface 48.

At this point, it may be desirable to remove the jointed milling assembly 60 and replace it with a non-jointed milling assembly. The non-jointed milling assembly may be more suitable depending on the consistency of the surrounding earth or formation.

Figure 9:
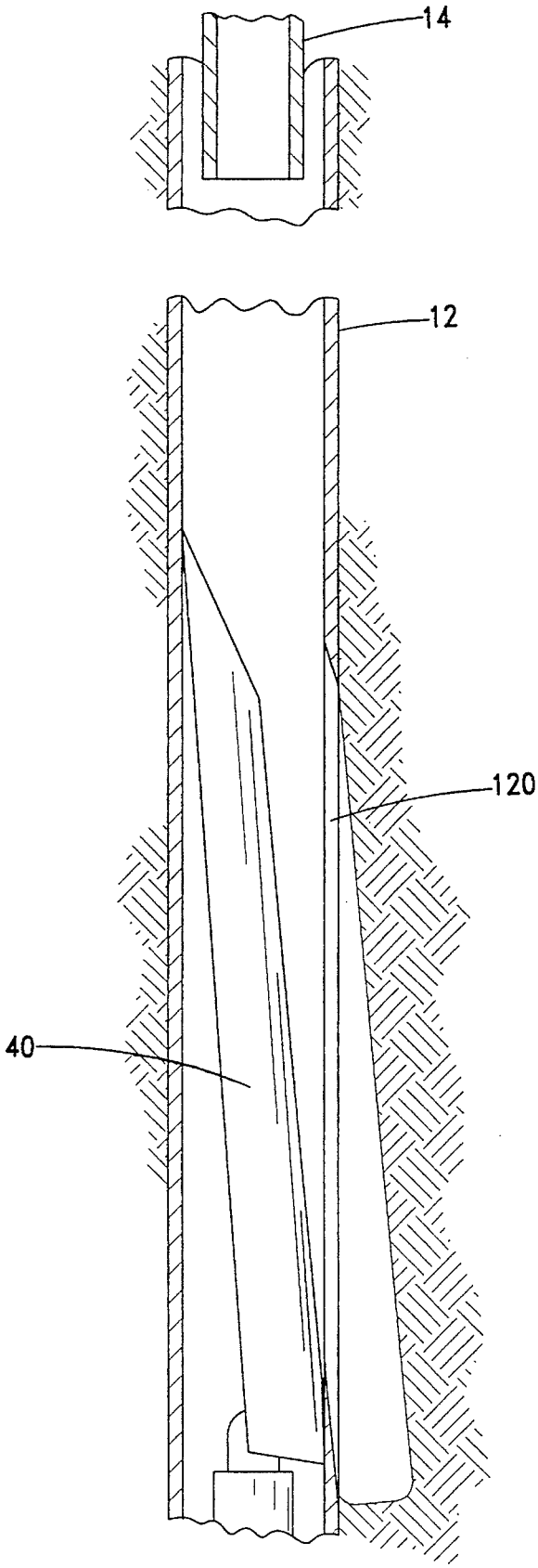
FIG. 9 is a longitudinal sectional view through the length of well casing shown in FIG. 2 with the milling tool removed and showing the completed window in the well casing.

In any event, the cutting of the window is completed and the window is dressed with conventional tools and according to known techniques. FIG. 9 depicts a completed window 120 with the milling assembly 60 and coiled tubing removed.

Now it will be apparent that the present invention provides a method and apparatus whereby a two stage whipstock and a knuckle-jointed milling tool are used to form a window in a well casing. Using the method of this invention, the problems heretofore attendant to the use of small diameter whipstocks and tools in a large diameter casing or conduit are eliminated or minimized.

Although the method of this invention has been described as being performed through a production tubing, it will be appreciated that the method is equally applicable to other down hole conditions where a window forming operation is to be performed in a conduit having a smaller diameter restriction of any kind through which the tools and whipstock must be passed. Other changes may be made in the combination and arrangement of the various parts, elements, steps and procedures described herein without departing from the spirit and scope of the invention as defined in the following claims.

I claim:

1. A milling assembly for forming a window in a subsurface well conduit, comprising:

a mill;

a motor; and a joint comprising:

a first end member having a first end adapted for connection to the motor and a second end;

a second end member having a first end adapted for connection to the mill and a second end;

a joint assembly for connecting the second ends of the first and second end members, the joint assembly characterized as permitting angular movement relative to the longitudinal axis of the joint but preventing rotational movement of the mill relative to the motor;

wherein the first end member, the connecting member, the second end member and the joint assembly define a continuous longitudinal passage for fluid flow therethrough between the mill and the motor.

2. A method for forming a window in a subsurface well conduit, comprising the steps of:

setting a whipstock inside the conduit at a selected location, the whipstock characterized by a two stage guide surface;

lowering a jointed milling assembly into the conduit above the whipstock using coiled tubing;

further advancing the jointed milling assembly until the mill impinges on the first stage of the whipstock's guide surface bending the joint of the jointed milling assembly and directing the mill at the conduit;

continuing to advance the jointed milling assembly along the guide surface of the whipstock until the mill reaches the second stage of the guide surface and the joint straightens; and continuing to advance a milling assembly until the formation of the window is completed.

3. The milling assembly of claim 1 wherein the mill is a starting mill.

4. The milling assembly of claim 1 wherein the first end member has a through bore which terminates at the second end of the first end member in a frusto-conical portion, and wherein the through bore defines a concave portion adjacent the frusto-conical portion, wherein the second end of the second end member has internal threads, and wherein the joint assembly includes a connector comprising a shaft with a first end and a second end and a through bore, the first end of the shaft being threaded for engaging the internal threads in the second end of the second end member, wherein the joint assembly further includes a ball member supported on the second end of the shaft, the ball shaped to be received in the concave portion in the through bore of the first end member, and wherein the second end member has a through bore, the through bores of the first and second end members and the shaft forming the longitudinal passage for fluid flow between the mill and the motor.

5. The milling assembly of claim 4 wherein the concave portion is provided with a plurality of elongated recesses aligned parallel to the longitudinal axis of the through bore, wherein the ball is provided with an equal number of elongated recesses positioned so as to be opposite the recesses in the concave portion of the through bore of the first end member when the ball is positioned in the concave portion, wherein the joint assembly further includes a ball bearing between each of the plurality of elongated recesses in the concave portion and the opposing elongate recess in the ball member.

6. The method of claim 2 further comprising the step of dressing the window after the formation of the window is completed.

7. The method of claim 2 wherein the jointed milling assembly comprises a starting mill.

8. The method of claim 2 wherein the jointed milling assembly comprises:

a mill;

a motor; and a joint comprising:

a first end member having a first end adapted for connection to the motor and a second end;

a second end member having a first end adapted for connection to the mill and a second end;

a joint assembly for connecting the second ends of the first and second end members, the joint assembly characterized as permitting angular movement relative to the longitudinal axis of the joint but preventing rotational movement of the mill relative to the motor;

wherein the first end member, the connecting member, the second end member and the joint assembly define a continuous longitudinal passage for fluid flow therethrough between the mill and the motor.

9. The method of claim 8 wherein the first end member has a through bore which terminates at the second end of the first end member in a frusto-conical portion, and wherein the through bore defines a concave portion adjacent the frusto-conical portion, wherein the second end of the second end member has internal threads, and wherein the joint assembly includes a connector comprising a shaft with a first end and a second end and a through bore, the first end of the shaft being threaded for engaging the internal threads in the second end of the second end member, wherein the joint assembly further includes a ball member supported on the second end of the shaft, the ball shaped to be received in the concave portion in the through bore of the first end member, and wherein the second end member has a through bore, the through bores of the first and second end members and the shaft forming the longitudinal passage for fluid flow between the mill and the motor.

10. The method of claim 9 wherein the concave portion is provided with a plurality of elongated recesses aligned parallel to the longitudinal axis of the through bore, wherein the ball is provided with an equal number of elongated recesses positioned so as to be opposite the recesses in the concave portion of the through bore of the first end member when the ball is positioned in the concave portion, wherein the joint assembly further includes a ball beating between each of the plurality of elongated recesses in the concave portion and the opposing elongate recess in the ball member.

11. The method of claim 2 further comprising the step of replacing the jointed milling assembly with a non-jointed milling assembly after the jointed milling assembly reaches the second stage of the guide surface and the joint straightens, but before advancing the milling assembly to complete the window.

* * * * *